United States Patent [19]

Schuierer

[11] Patent Number: 4,741,061

[45] Date of Patent: May 3, 1988

[54] METHOD FOR WASHING MATERIAL WOUND ON A PERFORATED BEAM

[75] Inventor: Manfred Schuierer, Michelstadt, Fed. Rep. of Germany

[73] Assignee: Bruckner Apparatebau GmbH, Erbach, Fed. Rep. of Germany

[21] Appl. No.: 2,272

[22] Filed: Jan. 9, 1987

[30] Foreign Application Priority Data

Jan. 10, 1986 [DE] Fed. Rep. of Germany ..... 3600557

[51] Int. Cl.[4] ..... D06B 5/18

[52] U.S. Cl. ..... 8/155.1; 68/189

[58] Field of Search ..... 8/155.1; 68/150, 189

[56] References Cited

U.S. PATENT DOCUMENTS 3,640,100 2/1972 Marz ..... 68/150

3,916,653 11/1975 West et al. ..... 68/189 X 4,206,619 6/1980 Fukuroi et al. ..... 68/189 X

*Primary Examiner*—Philip R. Coe

*Attorney, Agent, or Firm*—C. O. Marshall, Jr.

[57] ABSTRACT

The invention relates to a method and to apparatus for washing material wound on a beam, in which from the time at which a specific degree of cleanness has been reached in the central region of the roll length until the end of the washing process the proportion of the washing fluid coming out of the central region of the roll length is returned directly to the beam. In this way water and energy can be saved on a considerable scale.

1 Claim, 1 Drawing Sheet

METHOD FOR WASHING MATERIAL WOUND ON A PERFORATED BEAM

Figure 1:
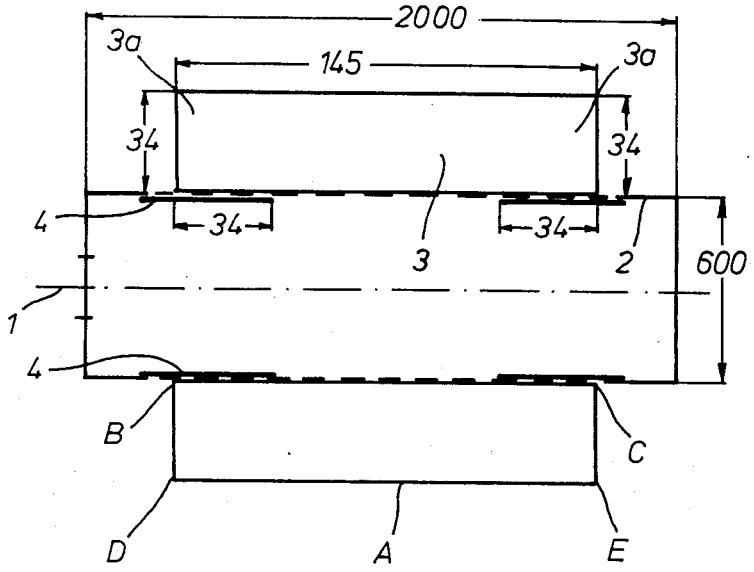

The invention relates to a method for washing material wound on a perforated beam.

In commercial beam washing the washing fluid which is delivered through the beam has to be at a certain internal positive pressure (approximately 0.3 to 1.2 bars). This means that the perforations in the beam must be covered in the region of the two end edges of the roll of material to prevent the escape of washing fluid since otherwise the washing solution "shoots out" at these points.

Because of this necessary covering of the perforations in the beam in the region of the two end edges of the roll of material it takes approximately twice as long in the edge region as in the central region of the roll length for the fluid to flow through the entire thickness of the roll. Even in the actual washing processing it has been shown that the cylindrical central part of the roll of material has been clean for a long time when washing is still going on in the region of the two end edges.

The object of the invention is to provide a method of washing material wound on a perforated beam in such a way that a substantial saving of washing fluid and energy is achieved.

According to the invention, from the time at which a specific degree of cleanness has been reached in the central region of the roll length until the end of the washing process the proportion of the washing fluid coming out of the central region of the roll length is returned directly to the beam and only the remaining proportion of the washing fluid is replaced by fresh washing fluid. In this way, from the time at which the central region of the roll length is clean the washing fluid coming out from it and the thermal energy contained in the fluid are not extracted from the system but are returned directly into the washing circulation. In this way approximately 30 to 40% water and energy can be saved by comparison with the conventional method.

Figure 2:
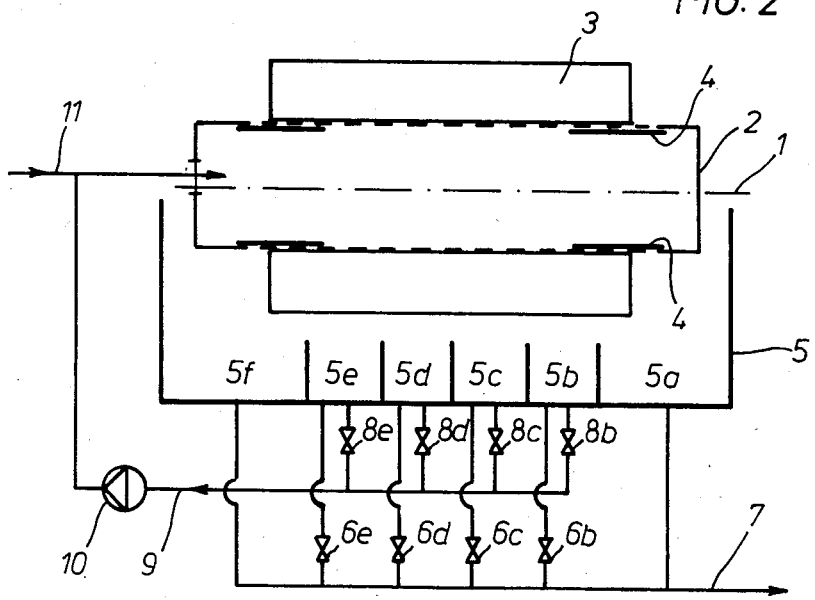

One embodiment of the invention is illustrated in the drawings, in which:

FIG. 1 shows a schematic representation of a washing beam with a roll of material wound on it in order to explain the flow conditions, FIG. 2 shows a schematic representation of apparatus for carrying out the method according to the invention.

First of all the typical flow conditions for beam washing are explained with the aid of FIG. 1.

The beam 2 which is rotatably mounted and perforated on its periphery carries a roll 3 of the material to be washed. Washing fluid is forced outwards from the interior of the beam 2 through the roll 3.

In the region of the two end edges of the roll the perforations of the beam 2 are sealed against the escape of washing fluid by covers 4.

It should now be assumed that the beam 2 and the roll 3 have the dimensions (in cm) shown in FIG. 1. The length (34 cm) sealed by the covers 4 in the region of the two end edges of the roll 3 corresponds to the thickness of the roll (also 34 cm). In these circumstances the washing fluid also flows through the outer edge zones 3*a* of the roll 3.

If the time needed for the washing fluid to reach the individual outer regions of the roll 3 from the interior of the beam 2 is measured, then considerable differences are established: If a fluid passage time of approximately 6 minutes is measured at points A, B and C, then at point D and E a fluid passage time of approximately 12 minutes is determined. Therefore in the washing process the central region of the roll length has been clean for a long time when washing is still being carried out in the region of the two end edges of the roll.

FIG. 2 shows apparatus according to the invention with which a significant improvement in the washing process can be achieved.

The perforated beam 2 which is rotatably mounted, carries the roll of material 3 and is provided with the covers 4 which are explained above is located above a tank 5 which is divided into a plurality of sections 5*a* to 5*f* which lie adjacent to one another in the longitudinal direction of the roll.

The two ouer sections 5*a*, 5*f* are connected directly to a discharge pipe 7 and the sections 5*b* to 5*e* are each connected thereto by a controllable valve 6*b* to 6*e*.

The sections 5*b* to 5*e* are also connected by controllable valves 8*b* to 8*e* to a return pipe 9 in which a pump 10 is arranged and which is connected together with a fresh water pipe 11 to the interior of the beam 2.

In the washing process first of all the valves 8*b* to 8*e* are closed and the valves 6*b* to 6*e* are opened. Fresh washing fluid is delivered to the beam 2 via the fresh water pipe 11 and after it has passed through the roll 3 is removed via the discharge pipe 7.

When at a specific time the central region of the roll length has reached a certain degree of cleanness, the valves 8*c* and 8*d* are opened and the valves 6*c*, 6*d* are closed. The proportion of the washing fluid coming out of sections 5*c*, 5*d* of the tank 5 is consequently returned via the return pipe 9 and the pump 10 directly to the beam 2 so that the quantity of fresh washing fluid delivered via the fresh water pipe 11 can be correspondingly reduced.

As the washing process progresses further the valves 8*b*, 8*e* can also be opened and the valves 6*b*, 6*e* closed as required, so that the proportion of the washing fluid coming out of the sections 5*b*, 5*e* can also be returned to the beam 2. Thus in the last part of the washing process it is only necessary for the proportion of washing fluid discharged in the region of the edges which are still dirty (i.e. from the sections 5*a*, 5*f* of the tank 5) to be replaced by fresh water.

I claim:

1. Method of washing material wound on a perforated beam (2), in which (a) the material is wound on the beam (2) and the perforations in the beam are sealed in the region of the two end edges of the roll of material (3) to prevent the escape of washing fluid, (b) and washing fluid is forced outwards from inside through the roll (3), characterised in that (c) from the time at which a specific degree of cleanness has been reached in the central region of the roll length until the end of the washing process the proportion of the washing fluid coming out of the central region of the roll length is returned directly to the beam (2) and only the remaining proportion of the washing fluid is replaced by fresh washing fluid.

* * * * *